US008430045B2

(12) United States Patent
Hewitt et al.

(10) Patent No.: US 8,430,045 B2
(45) Date of Patent: Apr. 30, 2013

(54) ON BOARD LIFT LEG CONSTRUCTION FOR PONTOON BOATS WITH ONBOARD ENGINE

(75) Inventors: Troy L. Hewitt, Nicollet, MN (US); Kent M. Evans, North Mankato, MN (US); Gary D. Hodapp, Madison Lake, MN (US)

(73) Assignee: Hewitt Machine & MFG., Inc., Nicollet, MN (US)

( * ) Notice: Subject to any disclaimer, the term of this patent is extended or adjusted under 35 U.S.C. 154(b) by 299 days.

(21) Appl. No.: 12/880,582

(22) Filed: Sep. 13, 2010

(65) Prior Publication Data

US 2012/0060742 A1 Mar. 15, 2012

(51) Int. Cl.

| | |
|---|---|
| ***B63B 1/10*** | (2006.01) |
| ***B63B 17/00*** | (2006.01) |
| ***B63C 1/00*** | (2006.01) |
| ***B63C 3/06*** | (2006.01) |

(52) U.S. Cl.

USPC ..... 114/44; 114/61.1; 114/343; 405/3

(58) Field of Classification Search ..... 114/44–48, 114/50, 51, 61.1, 263, 264, 265, 294, 343, 114/344; 405/1–3, 196–200, 203–209; D12/316–318

See application file for complete search history.

(56) References Cited

U.S. PATENT DOCUMENTS

| | | | | |
|---|---|---|---|---|
| 331,460 | A * | 12/1885 | Suckow | 254/101 |
| 2,443,209 | A * | 6/1948 | Thornburg | 254/423 |
| 2,600,761 | A * | 6/1952 | Halliburton | 405/197 |
| 2,664,577 | A | 1/1954 | Sanborn | |
| 2,997,852 | A * | 8/1961 | Suderow | 405/201 |
| 3,021,965 | A | 2/1962 | Harvey | |
| 3,177,668 | A | 4/1965 | Schneider et al. | |
| 3,260,377 | A | 7/1966 | Vilter | |
| 3,300,796 | A | 1/1967 | Powers | |
| 3,479,828 | A | 11/1969 | Luque | |
| 3,483,838 | A * | 12/1969 | Rath | 114/60 |
| 3,612,201 | A * | 10/1971 | Smith | 180/8.6 |
| 3,753,355 | A | 8/1973 | Knoch | |

(Continued)

FOREIGN PATENT DOCUMENTS

DE 2345754 A1 3/1975

OTHER PUBLICATIONS

Related Official Action dated Nov. 1, 2010, for U.S. Appl. No. 12/401,096, filed Mar. 19, 2009, 5 pgs.

*Primary Examiner* — Ajay Vasudeva

(74) *Attorney, Agent, or Firm* — Peter J. Ims; Westman, Champlin & Kelly, P.A.

(57) ABSTRACT

An onboard lift leg construction for a pontoon boat has a plurality of movable support legs including rear telescoping tube support legs that are fixed to a frame of a pontoon boat. The telescoping tube support legs each include an outer tube fixed to the frame, and an inner tube slidably mounted within the outer tube. A linear hydraulic actuator is secured to a head member that is supported on the outer tube. The actuator has an extendable and retractable rod that is attached or secured to the lower end of the inner tube such that when the actuator is extended, the inner tube is also extended to effectively lift the pontoon boat to which the outer tube is attached. The forward portions of the pontoon boat frame can be provided with pivoting lift legs for lifting the pontoon boat.

14 Claims, 10 Drawing Sheets

U.S. PATENT DOCUMENTS 3,879,781 A 4/1975 Roschynialski
4,070,978 A 1/1978 Virgilio
4,254,730 A 3/1981 Crenshaw
4,494,883 A 1/1985 Winter
4,773,346 A * 9/1988 Blanding et al. ..... 114/45
4,787,327 A 11/1988 Porter
4,850,741 A 7/1989 Timmerman
5,042,417 A 8/1991 Raymond
5,096,159 A 3/1992 Fletcher
5,115,753 A 5/1992 Craddock
5,163,378 A 11/1992 Raymond
5,184,561 A 2/1993 Nickell, Jr.
5,184,914 A 2/1993 Basta
5,199,686 A 4/1993 Fletcher
5,558,034 A 9/1996 Hodapp
5,562,362 A 10/1996 Vezner
5,772,360 A 6/1998 Wood, III
5,888,019 A 3/1999 Quastad
5,908,264 A 6/1999 Hey
6,059,263 A 5/2000 Otema et al.
6,523,491 B1 2/2003 Moise, II et al.
6,554,533 B2 4/2003 Godbersen
6,695,336 B1 2/2004 Grabenstetter
6,695,533 B1 2/2004 Bulmann
6,823,809 B2 11/2004 Hey
6,830,002 B1 12/2004 Walker
6,907,835 B1 6/2005 Derner et al.
6,976,442 B2 12/2005 Hey et al.
6,983,707 B2 1/2006 Derner et al.
7,051,665 B2 5/2006 Derner et al.
7,156,030 B2 1/2007 Derner et al.
7,188,580 B1 3/2007 Borman
7,246,970 B2 7/2007 Hey
7,267,066 B2 9/2007 Derner
7,318,385 B2 1/2008 Derner

* cited by examiner

ON BOARD LIFT LEG CONSTRUCTION FOR PONTOON BOATS WITH ONBOARD ENGINE

BACKGROUND OF THE DISCLOSURE

The present disclosure relates to a lift structure that is mounted onto the frame of an inboard/outboard pontoon boat that has an onboard engine. The lift structure is used for raising the pontoon boat above the water level of a lake or other body of water in which the boat is used, when the boat is to be docked.

There are boat lift structures that have four pivoting legs that are mounted onto the four corners of a pontoon boat frame and which legs can be pivoted into a position wherein the boat is lifted. These lifts have been shown in a number of different art patents including Hodapp U.S. Pat. No. 5,558,034 and U.S. publication No. 2009-0235857, and a series of patents to Derner exemplified by U.S. Pat. No. 6,907,835.

In general these existing "on board" lift structures disclose a plurality of legs which are pivotally mounted onto the boat frame and can be moved from a stowed position wherein the legs are generally parallel to the deck of the boat and underneath the boat, to an extended position where the legs pivot downwardly until the legs are relatively upright, to raise the boat after pads at the outer end of the legs engage the bottom of the body of water. Hydraulic actuators or electric actuators can be used for operating the pivoting legs.

The operation of the pivoting legs can be done in pairs, or individually, in the prior art. However, when the pontoon boat has an onboard engine, the engine support housing or pod projects below the deck at the rear of the boat and is in the way of pivoting legs at the rear.

SUMMARY OF THE DISCLOSURE

The present disclosure includes an on board lift for lifting a pontoon boat with an onboard engine mounted between outer pontoons. The lift preferably includes pivoting legs at the front and telescoping tube support leg assemblies secured to the boat frame at the rear, where there is no room for pivoting support legs. The telescoping tube support legs are operated with linear actuators to extend or retract bottom support pads for a lifting function as the front pivoting support legs are operated. The actuators may be telescoping multistage actuators for adequate extension. The lower ends of the telescoping tube support legs can be retracted when the boat is to be used, to be substantially in a position where they create little drag for the boat.

The pivoting legs at the front of the pontoon boat operate as shown in U.S. publication 2009-0235857, the content of which is incorporated by reference, and the pending U.S. patent application Ser. No. 12/407,096, Filed Mar. 19, 2009, on which publication No. 2009-0235857 issued, is also incorporated by reference.

The telescoping tube support legs at the rear of the pontoon boat have an outer tube section rigidly attached or fixed to the boat frame. There are no pivoting parts, but instead linear extension of one or more inner tubes of each telescoping tube support leg provides the lifting function. The telescoping tube support legs of the present disclosure are capable of being used on boats where a motor pod or support housing or other devices underneath the boat frame make use of pivoting legs impractical or impossible.

The fixed outer telescoping support leg tube has a slidably mounted inner tube leg section, and a linear actuator, as shown, a hydraulic actuator, is placed on the interior of the inner tube leg section. In a preferred embodiment, the telescoping tube support leg can be made in three telescoping tubes, with a two stage telescoping hydraulic actuator, with the telescoping sections providing the lift force and movement. The connections to power the actuator are at an upper end of the respective telescoping support leg assembly, and thus the connections are not underwater when the boat is floated.

The lift system of the present disclosure forms a hybred lift system with both pivoting and linearly extendable legs, that can be operated with suitable controls.

DETAILED DESCRIPTION OF EXEMPLARY EMBODIMENTS

Figure 1:
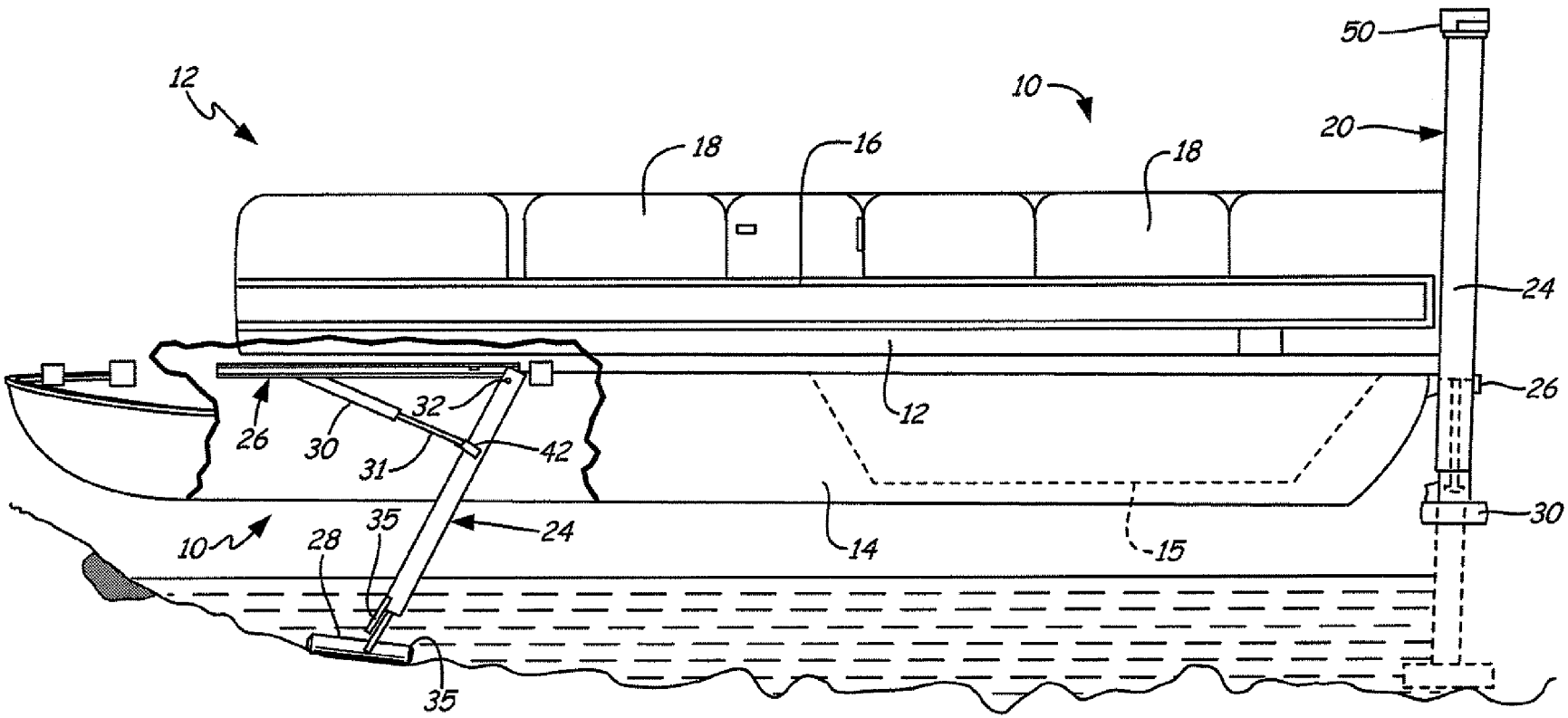
FIG. 1 is a side elevational view of pontoon boat on board lift with front pivoting support legs and rear telescoping lift legs made according to the present disclosure.
Figure 2:
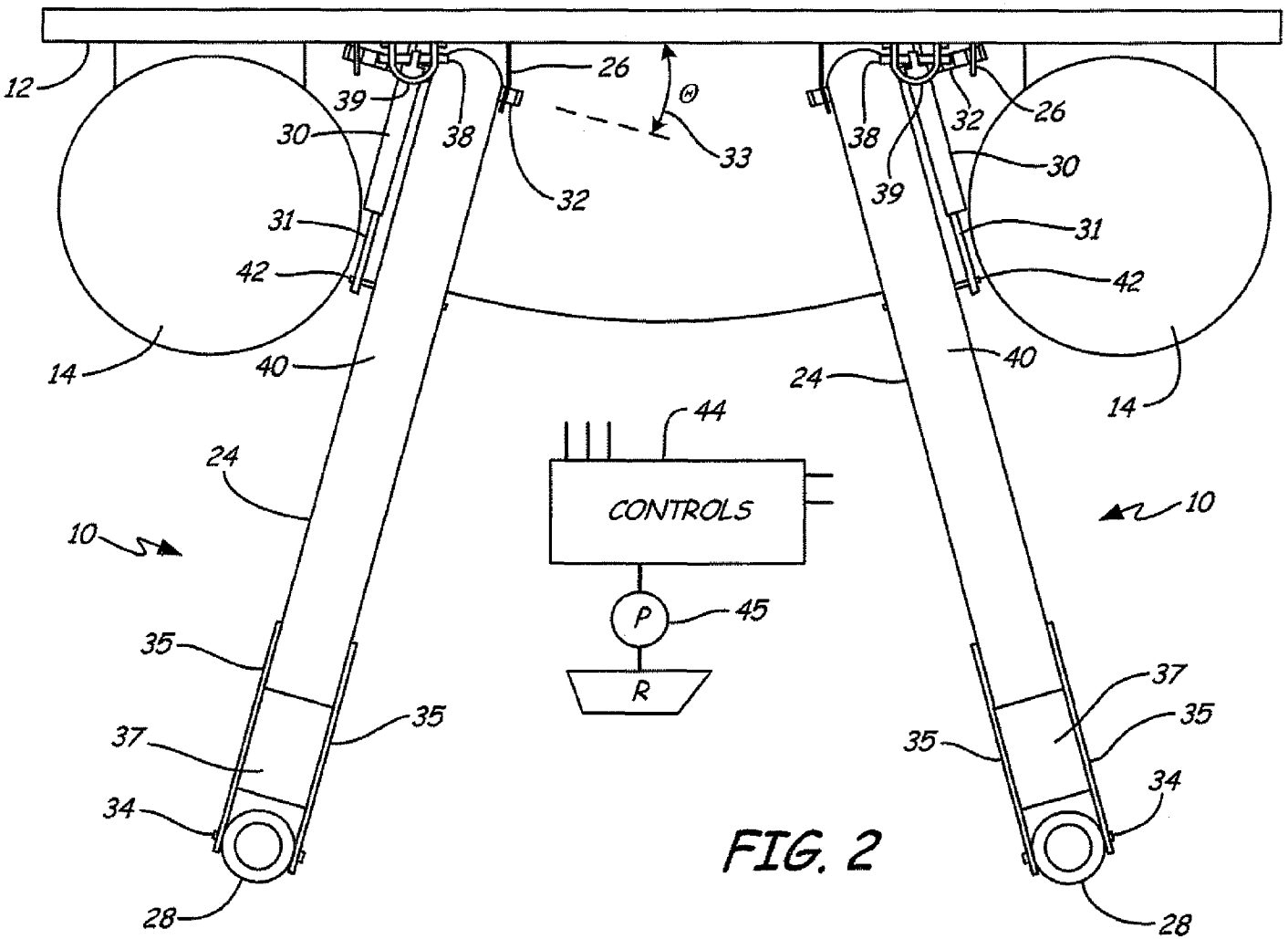
FIG. 2 is a front view of the pontoon boat shown in FIG. 1 with the front support legs in an extended working or lifting position.
Figure 5:
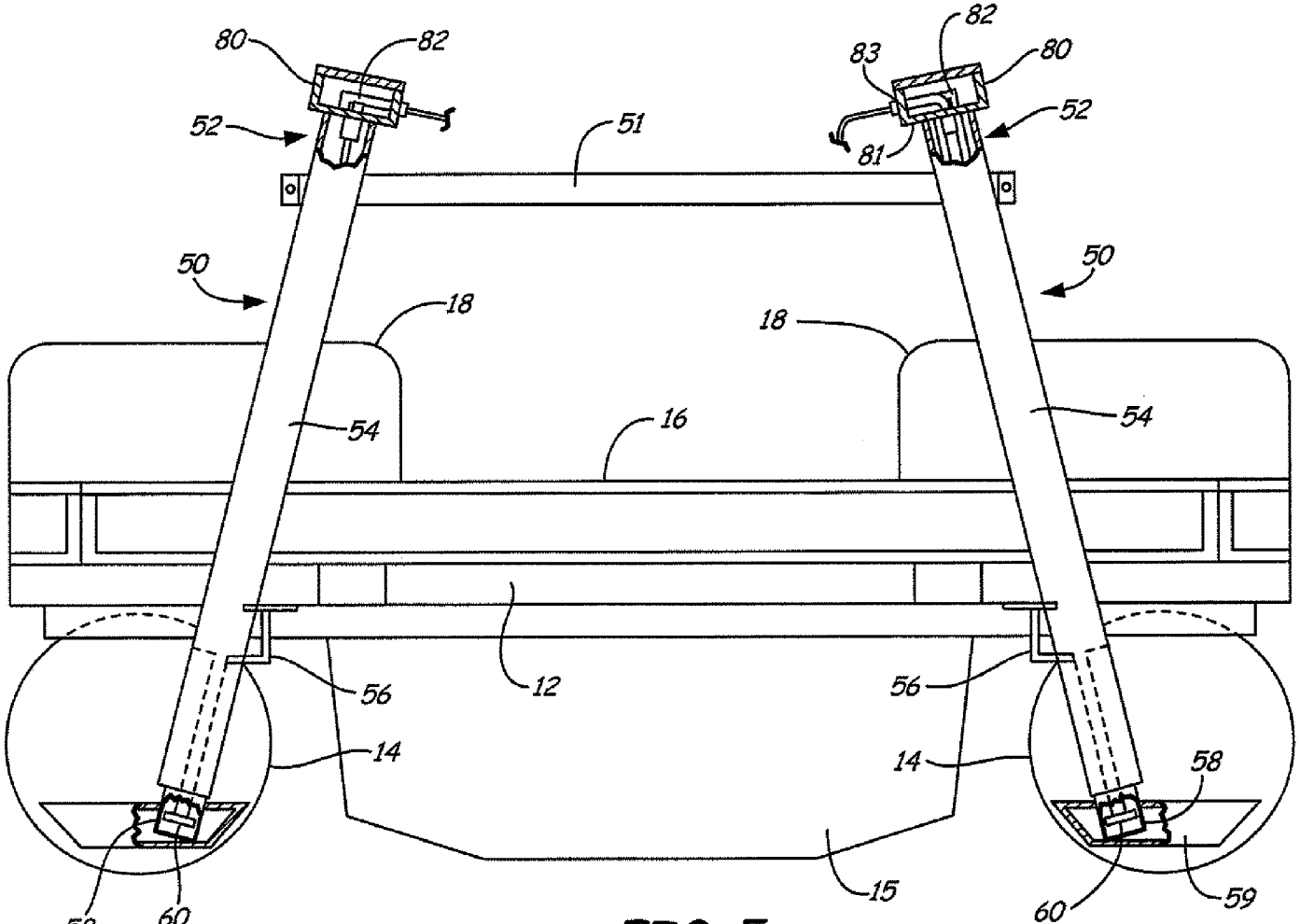
FIG. 5 is a rear elevational view of the pontoon boat of FIG. 1.

A pontoon boat 10 includes an on board lift assembly. The pontoon boat 10 includes a frame 12 that supports spaced pontoon members or floatation members 14 below the frame, and a deck 16 above the frame 12. As shown in FIGS. 2 and 5 there are two pontoons 14, and an engine support housing or pod 15 is positioned between the pontoons 14 at the rear portions of the pontoon boat. The engine support housing or pod 15 extends forwardly about one-half the length of the pontoon boat, as shown in dotted lines in FIG. 1, so there is a clear space between the pontoons 14 at the forward portion of the pontoon boat. A suitable railing or guard 18 is above the platform 16. This pontoon boat is driven by an onboard engine mounted in the support housing or pod 15, which drives an outboard drive shaft and propeller.

The pontoon boat 10 onboard lift assembly includes four legs, including a pair of front pivoting legs 24 and a pair of rear telescoping tube support leg assemblies 50. The front legs extend from pivot pins 32 supported on brackets 26 attached to the bottom of frame 12, to a remote end where a foot or support pad 28 is pivotally mounted on pivot pins 34. The pins 34 are supported on side straps 35 that extend downwardly from the remote or lower end of the legs 24. A stop member 37 is provided to keep the forward ends of the pads 28 from pivoting downwardly beyond a position parallel with the leg on which is mounted. In FIG. 1 the outside pontoon 14 is broken away to show the support legs.

The legs 24 are continuous (non-perforated) tubular members, that as shown are right circular cylinders throughout their length, with no openings or gaps to the interior. The legs are of strength and size to adequately support the front of pontoon boat 10 when the legs 24 are in their extended or working position with the pontoon boat 10 raised. The rear of the pontoon boat 10 will be supported on the telescoping tube support legs 50, as will be explained. Pivot pins 32 are inclined or tilted relative to the plane of the frame 12, as shown by double arrow 33, so that the lower ends of the legs 24 are spread outwardly more than the distance between the legs where they attach to the pontoon boat frame 12.

Figure 3:
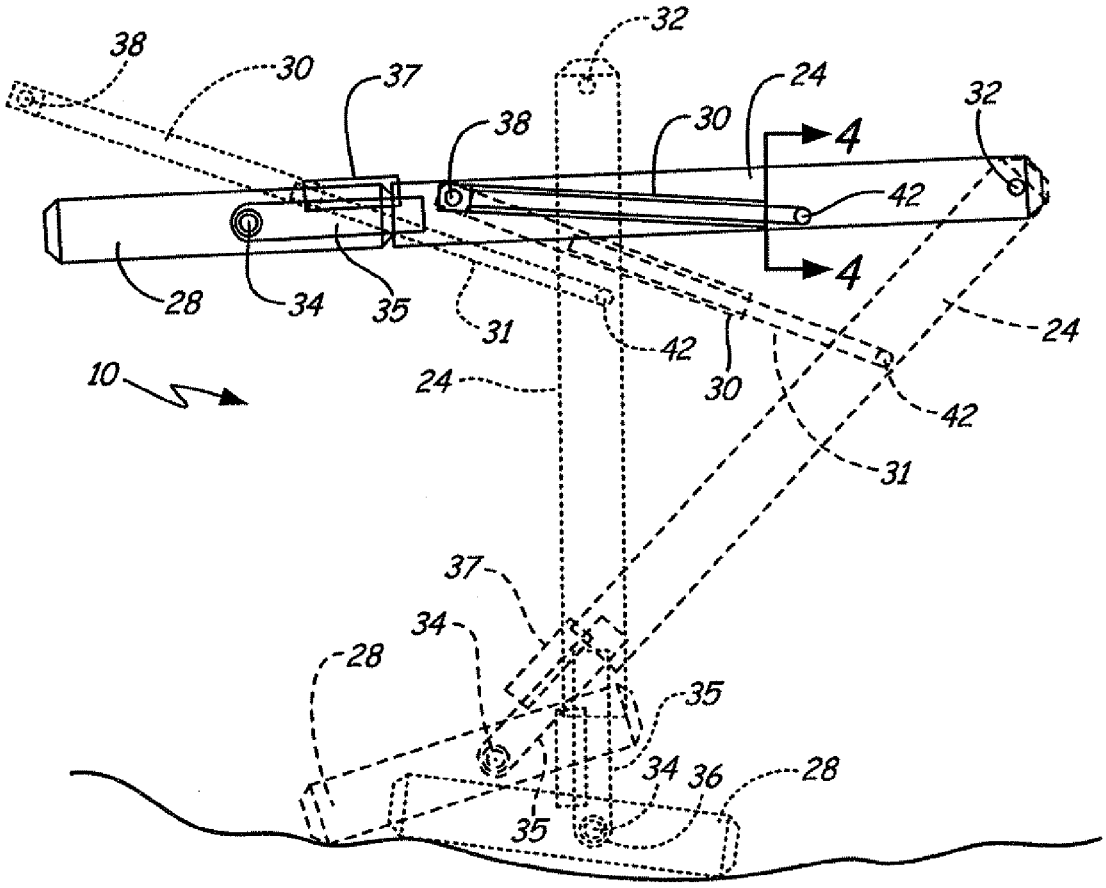
FIG. 3 is a side view of a single pivoting leg illustrating the mounting of an actuator and showing of the relative pivoting front leg positions in a stowed position in solid lines and in the extended or working positions in dotted lines.
Figure 4:
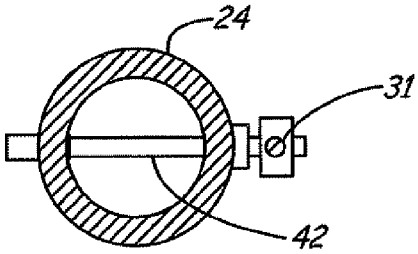
FIG. 4 is a sectional view taken along lines 4-4 in FIG. 3.

In order to actuate the pivoting legs, each of the legs is provided with a hydraulic actuator 30. The hydraulic actuators 30 have extendable and retractable rods 31 that are positioned to be mounted to the outer sides of the legs 24, as can be seen in FIGS. 2, 3 and 4. The base ends of actuators 30 are suitably mounted on pivot pins 38 that are supported on suitable brackets 39 attached to the underside of the frame 12. The pivot pins 38 are inclined so they are parallel to the pins 32. Thus, the legs 24 and the base end of actuators 30 are mounted on pins with parallel axes. The rods of actuators 30 can be extended and retracted in a normal manner through operation of known controls 44 by a boat operator. The actuator rods have outer ends that are pivotally mounted on suitable pivot pins 42 on the legs 24. The pin 42 on each leg is fixed in place and extends across the tube so that the rod end and the actuator itself are to the outer side of the respective leg 24.

The actuators 30 are operated through suitable valves in the controls 44, which will control flow of fluid from a suitable hydraulic pump 45, to the individual actuators. The actuators 30 can be operated in parallel so that, for example, the front two legs 24, which are shown to the left in FIG. 1, can be raised and lowered simultaneously. The controls also can be such that the pivoting legs can each be individually operated. Suitable sensors, such as level sensors, can be used with the controls so that the pontoon boat will not be tipped over when it is raised, or excessively slanted laterally or in fore and aft directions as the legs are operated. It should be noted that the legs 24 are made such that the pivotal mounting 32 is toward the rear of the pontoon boat relative to the outer ends of the legs. The legs 24 will be lifted as they pivot upwardly so that the outer ends move forwardly. As the pivoting legs are extended from the stowed position, the outer ends move backwardly, so that the pontoon boat would tend to be moved forwardly after the feet or pads 28 have engaged the lake bottom. The rear leg assemblies 50 can be operated sequentially to accommodate this movement In a preferred stowed position, the legs 24 are substantially horizontal against the underside of the deck 12 and parallel to the pontoons 14. The legs themselves are positioned so that they clear the pontoons, and if there are three pontoons (a short center pontoon can be mounted ahead of the engine support housing or pod) that are spaced sufficiently to provide clearance, the pivoting legs and the actuators will fit between the pontoons in both the retracted and extended or working positions.

The onboard lift assembly, as stated, includes a pair of rear telescoping tube support leg assemblies 50. Each of the rear telescoping tube support leg assemblies is substantially identical, except they are made for right and left orientation.

As can be seen in FIG. 5, a first embodiment of the telescoping tube support leg assemblies 50 are inclined outwardly or splayed outward in a downward direction, so that the upper ends indicated at 52 are closer together than the lower ends. The larger spacing of the lower ends provides stability. A cross member 51 between the legs 50 is used for stability and also functions as a tow bar for towing skiers or inflatable tubes behind the pontoon boat.

The telescoping tube support leg assemblies 50 each include an outer telescoping leg tube or tube section 54, each of which is secured to a bracket 56 that is welded or otherwise secured onto the frame 12. The brackets 56 can be welded to the telescoping leg tubes 54 so there is a rigid connection between the outer telescoping leg tube 54 and the frame 12. The telescoping tube support leg assemblies each include an inner telescoping leg tube or tube section 58 that is slidably received in the outer tube 54 forming that telescoping tube support leg assembly. The tubes are of substantial length, as shown. The inner telescoping leg tubes 58 in turn have lower ends that are secured to pads or support feet 59, that are of sufficient size so that when they engage a soft bottom of a lake bed they will not embed substantially, but can be used for supporting the pontoon boat when the pontoon boat is raised above the water level.

Figure 6:
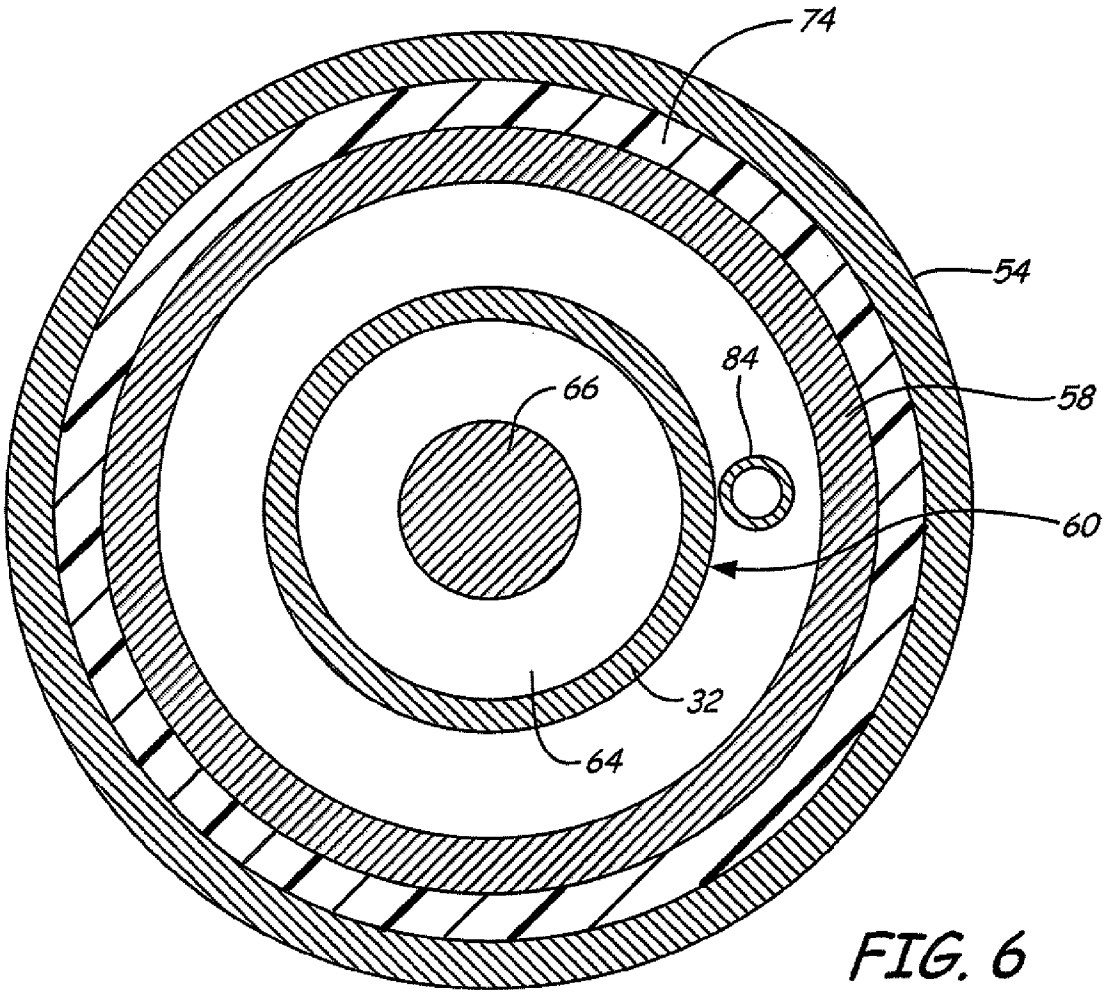
FIG. 6 is a sectional view of a rear telescoping lift leg and linear actuator taken generally along line 6-6 in FIG. 8.

The inner telescoping leg tube 58 of each telescoping tube support leg assembly 50, as shown in FIG. 6, is of smaller diameter than the inside surface of the outer telescoping leg tube 54. A linear actuator 60 is mounted inside the inner tube 58. The linear actuator includes an outer cylinder tube 62, and an inner ram assembly comprising a piston 64 that is slidably and sealably mounted to slide against the inside surface of the cylinder 62, and an extendable and retractable rod 66 secured to the piston. The base end of the cylinder 62 is secured to an upper end of outer tube 54 with a head member 80. The outer tube 54 and the base end of cylinder 62 can be welded to a bottom wall 81 of the head member 80.

Figure 7:
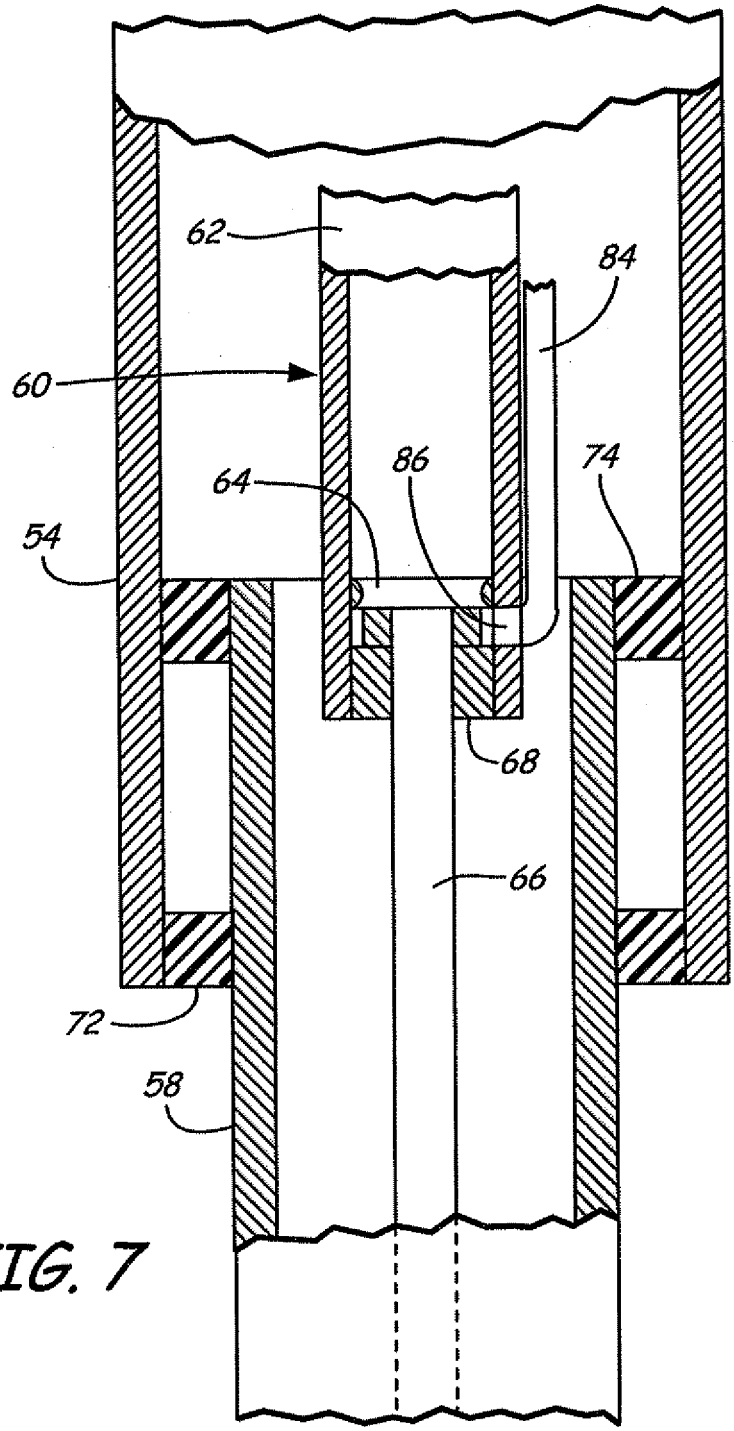
FIG. 7 is an enlarged fragmentary longitudinal sectional view of the rear telescoping tube lift leg and actuator in an extended position fragmentarily showing the sliding support for the telescoping tubes and the linear actuator elements.

As shown in FIG. 7, the actuator rod 66 is slidably mounted through an end block 68 that closes the lower end of the cylinder 62, and the rod 66 extends down to the lower end of the inner telescoping telescoping leg tube 58 of the respective support leg. The remote end of the rod 66 is secured to the lower end of the inner telescoping tube 58 in a suitable manner such as using a disc or plug 70 welded to the inner telescoping leg tube 58 and to the rod, as shown schematically in FIGS. 5 and 8. The piston 64 on the rod seals against the inner surface of the cylinder 62, and in this form of the disclosure actuator 60 is a double acting hydraulic actuator that has substantial length.

Figure 8:
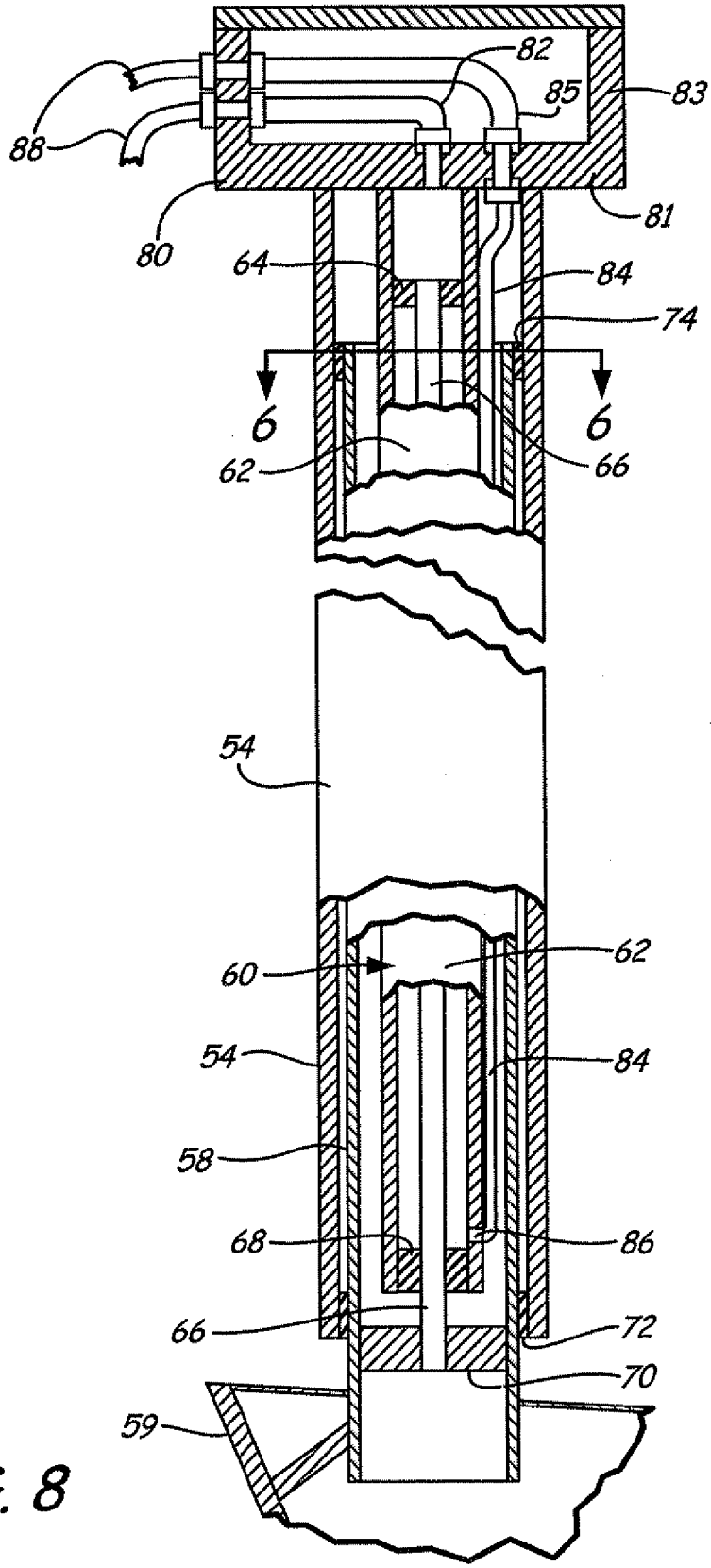
FIG. 8 is an enlarged fragmentary view of a telescoping tube lift leg assembly with parts broken away.

FIGS. 7 and 8 also show the use of wear collars or bushings for slidably guiding the inner telescoping leg tube 58 relative to the outer telescoping leg tube 54. A first wear collar or bushing 72 of suitable low friction material is fixed to the inner surface of the outer tube 54 and slides on the outer surface of the inner telescoping tube 58. The inner tube 58 slides through the collar 72. A second wear collar or bushing 74 that can be made of the same material as collar 72 is secured to the outer surface of the inner telescoping tube 58 and slides against the inner surface of the outer telescoping leg tube 54, as the inner telescoping leg tube of each telescoping tube support leg assembly is moved longitudinally by operation of the linear actuator 60.

Each linear actuator 60 is secured to a head member 80 at its base end, which is at the upper end of the outer tube 54. The head member 80 forms a chamber with a perimeter wall 83 and a hydraulic connection is made through the head member wall 81 to the interior of the base end of the cylinder 62 with a suitable connector and line shown at 82.

The rod end or remote end of the cylinder 62 of each hydraulic actuator is provided with fluid under pressure using a conduit 84 that is connected to the source of hydraulic fluid under pressure through the head member 80 with a connector and line 85, and a conduit 84 extends down along the outside of the cylinder 62. The cylinder 62 is spaced from the inner wall surface of inner telescoping leg tube 58 of the respective actuator assembly to provide enough clearance for the conduit 84. The conduit 84 provides fluid under pressure to the rod end of cylinder 62 through a port shown at 86 in FIGS. 7 and 8.

Hydraulic lines 88 are used for connecting the actuators 60 to the controls shown at 44, that can either be made to provide for individual operation of each of the linear actuators on the pontoon boat or can be made so that the front and rear actuators will operate in pairs. The controls 44 are provided with fluid under pressure from pump 45 in a normal hydraulic system including a reservoir.

The operation of the onboard lift assembly for a pontoon boat of the present disclosure is relatively straightforward. When the pontoon boat is near shore and the pontoon boat is going to be docked, the operator can operate the controls 44, to extend the hydraulic actuators for the support legs. These can be actuated in front and rear pairs or individually depending on the desires of the user. By running the pump 45 and operating the valves in controls 44, the actuator rods for the respective actuators will be extended. The front lift legs will be pivoted down to engage the lake bottom and the inner tubes telescoping leg 58 of the rear support leg assemblies will also extend at an appropriate time so that the lower ends of the tubes 58 carrying the support pads 59 will engage the bottom of the lake as the boat moves when the front pivoting legs move down. The support legs will raise the boat frame up to a level that is desired. The inner telescoping leg tubes 58 are of length so that when the actuator 60 is fully extended and the piston 64 stops on end block 68, the inner and outer telescoping leg tubes are stopped with sufficient overlap so they are stable, as shown in FIG. 7.

Hydraulic lines for the rear telescoping leg tubes can be run conveniently along the outside of the outer tubes 54, and under the deck 16 to the operator's location so that they are essentially hidden. This makes for a compact attractive operation package.

The telescoping leg tubes are selected to be of suitable size for strength and stability and the wear pads or bushings operate to guide the inner tubes as they are extended and retracted.

Again, the inner telescoping leg tube 58 is a sufficient diameter larger than the cylinder 62 to permit the conduit 84 to be placed against the cylinder 62 and clear the inner surface of the respective inner telescoping leg tube 58.

When the pontoon boat 10 is again to be floated, the controls 44 would be operated to retract the rods 31 of actuators 36 for the front pivoting legs and the rods 66 of the hydraulic actuators for the rear legs, and thus pivot the front legs upwardly and retract the inner telescoping leg tubes 58 into the outer telescoping leg tubes 54 of the rear telescoping leg tube assemblies. The inner tubes 58 can be retracted fully and the support legs create little drag in relation to the pontoon boat itself. As can be seen in FIG. 5, the pads at the ends of the telescoping leg tube assemblies are in line with the outer pontoons of the boat when retracted.

In some instances, it is desirable to have a relatively short rear telescoping lift leg assembly when in a retracted position, and still obtain a greater extension for lift action. In this case, a two stage telescoping actuator can be utilized for operating the tubular leg assemblies, and an additional inner section of the tubular support leg can be added so that the overall extension is increased, and/or the retracted length is decreased.

Figure 9:
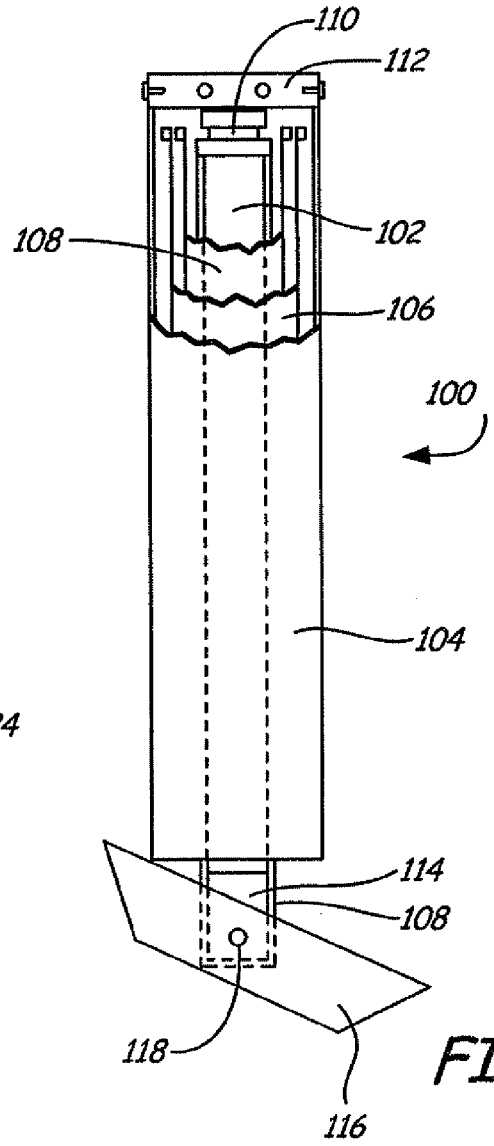
FIG. 9 is an embodiment of a telescoping tube support leg assembly used on a boat for getting extended lifting capabilities in a retracted position.

In FIG. 9, a modified telescoping tube support leg assembly is illustrated at 100 and in this modified form, a two stage telescoping hydraulic actuator 102 is used, so that the actuator provides greater stability for the amount of extension desired. The telescoping tube support leg assembly 100 includes an outer cylindrical telescoping leg tube 104, which surrounds an intermediate telescoping leg tube 106, which in turns surrounds a center or inner telescoping leg tube 108. The inner telescoping leg tube 108 surrounds the two stage telescoping hydraulic actuator 102, as shown. The inner leg tube 108 and intermediate leg tube 106 will slide longitudinally relative to each other and relative to outer leg tube 104, as the two stage telescoping hydraulic actuator 102 is extended or retracted. The actuator 102 includes an extendable and retractable rod 110, which in this instance is at the upper end of the telescoping tube support leg assembly 100. The outer end of rod 110 is secured to a hydraulic manifold head member 112 that will carry hydraulic fluid under pressure to the actuator 102 to permit extension and retraction.

The base end of the telescoping hydraulic actuator 102 has a mounting block 114 thereon, as shown in FIG. 9, and this mounting block 114 is secured to the inner telescoping leg tube 108 (which is shown in cross section in FIG. 9) and a pivoting pad or foot 116 is pivotally mounted onto the mounting block 114. A suitable pivot pin 118 can be used for mounting pad 116.

The two stage telescoping hydraulic actuator 102 includes an outer cylinder 120 on which the block 114 is mounted, and an inner cylinder 122 is slidably mounted in the outer cylinder 120. The inner cylinder 122 is actuable between a retracted and extended position relative to the outer cylinder 120. The extended position of the actuator 102 is illustrated schematically in FIG. 10, and as can be seen the rod 110 is extended out from inner cylinder 122, and the inner cylinder 122 is extended out from the outer cylinder 120. The rod 110 has a piston 111 at its inner end, and the extension of rod 110 is stopped with an internal stop ring 111A fixed to the cylinder 122, shown only schematically. The cylinder 122 acts as a piston rod for cylinder 120 and has a piston 123 that will engage on internal stop ring 123A to stop extension of the inner cylinder or rod 123. Again the stops are shown only schematically.

Extension of the cylinders causes inner telescoping leg tube 108 to be extended out of the intermediate telescoping leg tube 106, and intermediate telescoping leg tube 106 to extend from the outer telescoping leg tube 104. Cylinder 120 is surrounded by the telescoping leg tubes 108, 106 and 104. The telescoping leg tubes are stopped from over extending by the stops 111A and 123A being engaged. The tubes also have stops for back up stopping, as will be explained.

Figure 10:
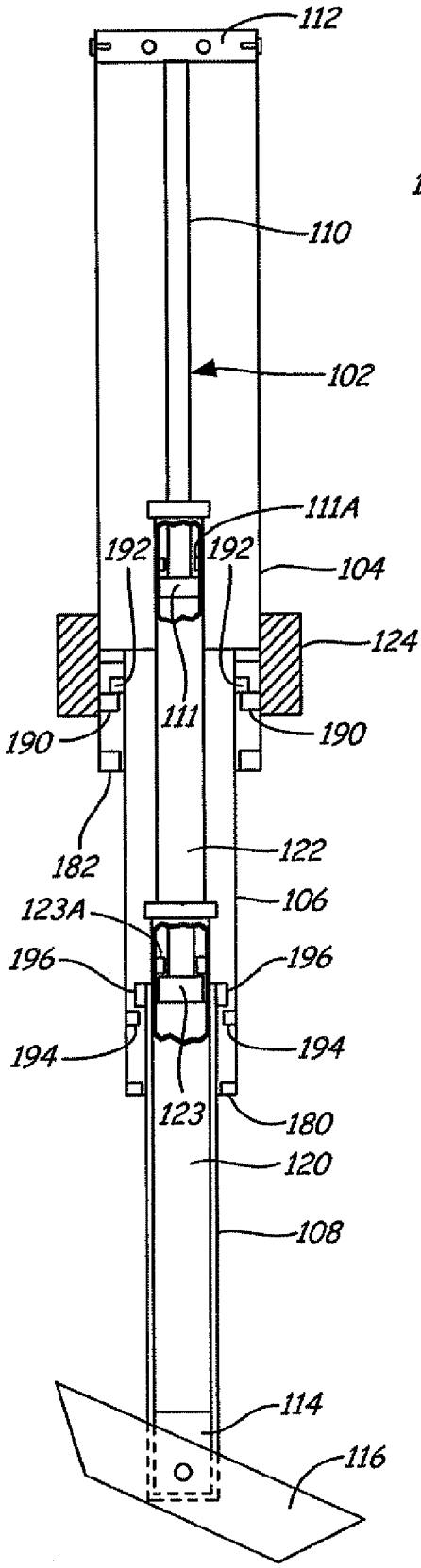
FIG. 10 is a schematic view of the telescoping tube support leg assembly of FIG. 9 in an extended position.

The outer tube 104 is attached to a bracket that is shown only schematically at 124 in FIG. 10. Bracket 124 is attached to the frame of the boat, generally as shown in FIG. 5. In this form the rod end of the actuator assembly 102 is connected to the head member 112, opposite from the mounting shown in the previous form of the disclosure. The telescoping tube support leg assembly 100 is illustrated vertically in FIGS. 9-12, but it can be inclined when mounted to a pontoon boat, as shown in FIG. 5. The type of bracket for joining the telescoping tube support leg assembly 100 to the pontoon boat frame can be adapted to any type of mounting bracket desired.

Figure 11:
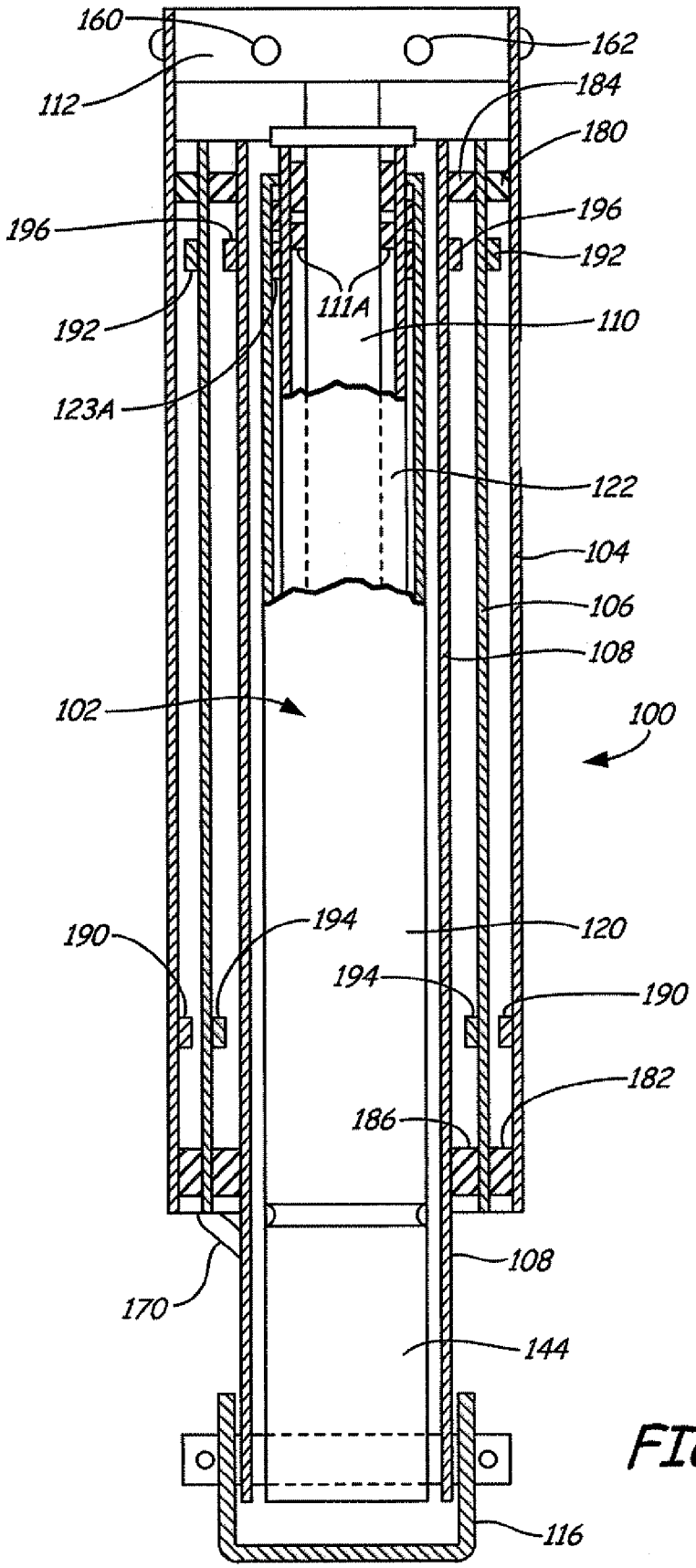
FIG. 11 is a vertical section view of the telescoping tube support leg assembly of FIG. 9 and showing a two stage hydraulic actuator with portions broken away.
Figure 12:
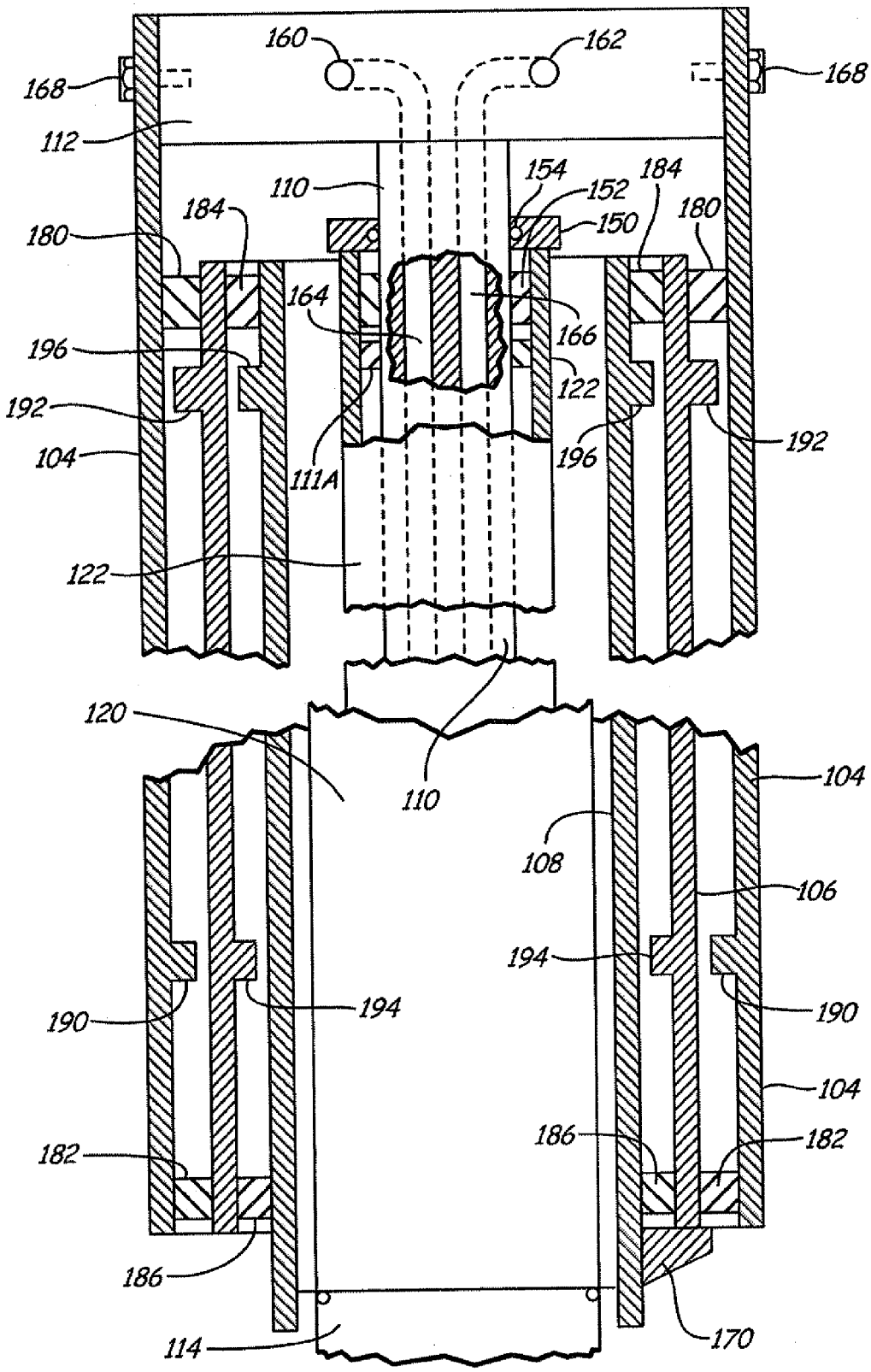
FIG. 12 is an enlarged sectional view of the upper and lower ends of the structure shown at FIG. 11 with the center portions broken away.

Referring to FIGS. 11 and 12, the telescoping tube support leg assembly 100 is illustrated in cross section for showing the mounting arrangement of the telescoping leg tubes. The two stage telescoping hydraulic cylinder assembly illustrated at 102 is shown on the interior of the inner telescoping leg tube 108, and the base or outer cylinder 120 of the actuator assembly 102 is illustrated in partial cross section surrounding the inner cylinder tube section 122, which in turn slidably mounts the extendable and retractable hydraulic cylinder rod 110. The outer cylinder 120, inner cylinder 122 and rod 110 are mounted in a conventional manner for double acting telescoping hydraulic actuators. Telescoping hydraulic actuators are well known, and while the illustrated actuator 102 is a two stage actuator, U.S. Pat. No. 2,783,744 shows a multi-stage telescoping actuator, as does U.S. Pat. No. 4,516,468, both of which have pressure and return passageways in the center rod. A suitable two stage double acting telescoping actuator for providing telescoping leg tube extension and retraction is available from Custom Actuator Products of Minneapolis Minn. USA, (custom actuator products). The piston 132 inner cylinder 122 is slidably sealed relative to the interior wall of the outer cylinder 120 and the piston 111 on the rod 110 is slidably sealed relative to the inner cylinder 122. The actuator 102 has internal porting, guides for the telescoping sections and as shown schematically at 111A and 123A stops to prevent over extension. Extension stops are shown in U.S. Pat. No. 2,783,744, and the stops are built into the commercially available telescoping hydraulic cylinders or actuators.

The piston rod 110 and piston 111 are slidably fitted inside the inner cylinder 122, and as shown only schematically, it can be suitably guided with bushings 152, and has a seal 154 at an upper end cap 150, on the upper end of the inner cylinder 122.

The head member 112 is provided with suitable connection ports 160 and 162 that are connectable to hydraulic lines 88 as in the previous form of the disclosure, and these ports are connected with passageways that are formed in the head member, and which are open to the passageways 164 and 166 that extend axially down along the rod 110. Passageway 164 opens to interior chambers to cause the inner cylinder 122 and rod 110 to extend in sequence when pressure is provided. The passageway 166 connects to internal ports to carry return flow during extension of the actuator 102 and when passageway 166 is pressurized, it provides pressure to retract the rod 110 and the inner cylinder 122. Passageway 164 carries return flow during retraction of the actuator 102.

The outer telescoping leg tube 104 is secured to the head member 112 with suitable fasteners such as those shown at 168, and the rod 110, as can be seen, is also secured to the bottom side of the head member 112, either by way of sealing connections or welding or the like.

The intermediate telescoping leg tube 106 has a ring type, or other suitable configuration wear collar or bushing 180 secured to it at the end adjacent to head member 112, and the outer telescoping leg tube 104 has a ring type wear collar or bushing 182 secured to it at the end remote from the head member 112. The bushing 180 is carried with the intermediate telescoping leg tube 106 and slides against the interior surface of the outer telescoping leg tube 104, and the intermediate telescoping leg tube 106 slides on bushing 182 to provide for guiding the tube 106 as it is extended and retracted. Additional wear collar or bushings can be provided for stability if desired.

The inner telescoping leg tube 108 has a wear collar or bushing 184 secured at its end adjacent the head member 112, and a wear collar or bushing 186 is secured to the inner surface of intermediate telescoping leg tube 106 adjacent its lower end. The wear collar or bushing 184 slides against the inner surface of the intermediate telescoping leg tube 106 and the tube 106 slides on bushing 186, as the leg tubes slide longitudinally relative to each other.

The stops 111A and 123A of the hydraulic actuator 102 to control the extension of the leg tubes, but suitable stops or engageable members are provided to insure limiting the amount of longitudinal extension if the actuator stops permit it. The outer telescoping leg tube 104 has a ring like or annular stop member 190, spaced upwardly from the lower end of the outer telescoping leg tube 104 so that the tubes will overlap and will be stabilized and not overextended when they have their stops engaged. The intermediate telescoping leg tube 106 has an upper annular or ring type stop 192, and it is made so that it protrudes toward the outer telescoping leg tube 104 and will engage the stop 190 when the inner telescoping leg tube 106 is extended. The intermediate telescoping leg tube 106 also has an internal stop 194 that extends into the space between tube 106 and the inner telescoping leg tube 108 and is spaced upwardly from the lower end. The inner telescoping leg tube 108 has a stop 196 as its end adjacent the head member 112, which protrudes toward the intermediate telescoping leg tube 106 so that it will engage the stop 194 when the tube 108 extends outwardly. The stops, which may be rings, comprise engageable members that will stop extension of the telescoping leg tubes at the desired positions.

When the telescoping tube support leg assembly 100 is going to be extended to lift the rear portions of the pontoon boat or other boat from the water, hydraulic fluid under pressure will be supplied from control 44 through port 160 into the passageway 164, and this will provide a force that will cause the outer cylinder 120 to move down relative to inner cylinder 122.

The outer cylinder 120 moves away from the head member 112 and slides relative to outer telescoping leg tube 104, which is secured to the boat frame, and the cylinder 120 will pull the inner telescoping leg tube 108 with it, since the inner telescoping leg tube 108 is secured to the mounting block 114, as shown in FIG. 11. This will move the foot member 116 downwardly toward a lake bottom. The outer cylinder 120 and the inner telescoping leg tube 108 will continue to extend until the stop member 196 on inner telescoping tube 108 engages the stop 194 on the intermediate telescoping leg tube 106 will engage only when there is more extension of the actuator 102, since the internal stops engage. When the inner telescoping leg tube 108 extends so the stop 196 engages the stop 194, further extension will pull the intermediate telescoping leg tube 106 in a direction away from the head member 112. Once the outer cylinder 120 has reached its stop position by engagement of the piston 123 with the internal stop 123A the pressure will cause the inner cylinder 122 to extend and slide along the rod 110 in direction away from the head member 112, and the intermediate telescoping leg tube 106 will be pulled outwardly by the engagement of the stops 196 and 194 until The actuator stops engage to limit the amount of extension of the intermediate telescoping leg tube 106 from outer telescoping leg tube 104 before stops 190 and 192 engage. The stops 190 and 192 will only engage if there is more extension of the actuator 102 than desired.

The return oil that is flowing back to the valve block as the actuator 102 extends will be exited through the passageway 166.

The amount of overlap of the telescoping leg tubes, that is, the amount that the inner telescoping leg tube 108 is supported inside the intermediate telescoping leg tube 106 is selected so that the wear collar or bushings that are used provide adequate stability for the legs. Also, the intermediate telescoping leg tube 106 is held in position so that part of it remains within the outer telescoping leg tube 104, again to provide stability. The wear collar bushings or guides 180, 182, 184 and 186 are quite close fitting, and the overlap of the tubes ensures that the legs will be adequately stable.

It is to be noted that the telescoping two stage hydraulic actuator showing is exemplary, and somewhat schematic, in that the two stage telescoping hydraulic actuators of suitable size are available from various vendors.

Retraction of the telescoping support leg assembly 100 is done by providing pressure in passageway 166, which acts to retract the actuator 102. As the outer cylinder 120 retracts, the inner telescoping leg tube 108 is moved upwardly (toward the boat frame) with block 114. The inner telescoping leg tube 108 is provided with an engageable member comprising a finger or lug 170 (more than one finger or lug can be used), which engages the lower end of the intermediate telescoping leg tube 106 when the inner telescoping leg tube 108 is retracted into the leg tube 106. The further retraction of the actuator 102 lifts the intermediate telescoping leg tube 106 to retract it into the outer telescoping leg tube 104. This position of full retraction is shown in FIGS. 11 and 12.

The extension and retraction of the telescoping leg tube assemblies 100 can be controlled in the manner previously described, by operating suitable valves, and having extension feedback so that one of the telescoping leg tube assemblies does not extend greater than the other. They can be individually actuated, or can be operated in parallel.

Although the present invention has been described with reference to preferred embodiments, workers skilled in the art will recognize that changes may be made in form and detail without departing from the spirit and scope of the invention.

What is claimed is:

1. A lift for a pontoon boat having a frame and spaced pontoons attached to the frame and an engine support housing extending below the frame and between the spaced pontoons, the lift comprising a plurality of raisable and lowerable support legs, at least two of the support legs comprising individual extendable and retractable telescoping tube assemblies attached to said frame and in position so that when the telescoping tube assemblies are extended the frame will be raised relative to a support, the telescoping tube assemblies each including an outer tube fixed to the frame, an inner tube slidably mounted within the outer tube and extendable in a longitudinal direction of the outer tube, a linear actuator positioned on the interior of the inner tube and secured to a support base, said support base also being secured to said outer tube, the actuator having an extendable and retractable portion secured to an outer end of the inner tube, whereby extending the actuator will move the inner tube in a downward direction relative to the frame to engage a support surface and raise the frame.

2. The lift of claim 1 further comprising a first wear collar secured to an inner surface of the outer tube and slidably receiving an outer surface of the inner tube, a second wear collar secured to an outer surface of the inner tube at an end of the inner tube on an interior of the outer tube, said second wear collar slidably engaging an inner surface of the outer tube.

3. The lift of claim 1 wherein a first end of the actuator and an upper end of the outer tube are both secured to a base having power connections for the actuator.

4. The lift of claim 1 wherein the telescoping tube assemblies include an intermediate tube surrounding the inner tube and the inner tube and intermediate tube having portions engaging as the actuator extends to slide the intermediate tube longitudinally to extend from the outer tube.

5. The lift of claim 1 wherein said plurality of telescoping tube assemblies comprise two telescoping tube assemblies at rear corners of the frame relative to the normal direction of movement of the pontoon boat, lower ends of said telescoping tube assemblies being splayed outwardly in a lateral direction of the pontoon boat.

6. A boat lift leg construction for a pontoon boat having a frame, and a pair of support pontoons on a bottom of the frame extending along lateral sides of the frame; an engine support between the pontoons at a rear of the pontoon boat frame extending downwardly from the frame and terminating to leave a forward portion of the frame free of the engine support; a pair of pivoting legs pivotally mounted to the frame at the forward portion at a location free of the engine support below the frame; the pivoting legs being pivotally mounted to the frame for movement between an extended position and a stowed position; a first actuator for each of the pivoting legs for moving the respective leg between its extended and stowed positions; a pair of telescoping support legs at a rear portion of the frame; and each telescoping support leg comprising an outer tube fixed to the frame, and at least one inner tube slidably mounted relative to the outer tube and on an interior thereof, a head member secured to an upper end of the outer tube, a second actuator for each of the telescoping support legs having a first end secured to the respective head member and positioned on an interior of the respective inner tube, the second actuators each having an extendable and retractable member secured to a lower end of the inner tube, and power connections providing power to extend and retract the second actuators for the telescoping support legs.

7. The boat lift leg construction of claim 6 wherein the telescoping support legs are spaced apart laterally of a direction of movement of the pontoon boat, and are inclined such that the lower ends of the outer tube members are spaced farther apart laterally than the upper ends of the outer tube members of the telescoping support legs.

8. The boat lift leg construction of claim 6, wherein each of the telescoping support legs includes an intermediate tube slidably mounted on the interior of the outer tube and to the exterior of the inner tube.

9. The boat lift leg construction of claim 8 and cooperating engageable members on at least one of the inner tube and intermediate tube to slide the intermediate tube to extend and retract as the respective second actuator extends and retracts.

10. The boat lift leg construction of claim 9, wherein said second actuators comprise two stage telescoping double acting hydraulic actuators.

11. The boat lift leg construction of claim 6 wherein each second actuator is a hydraulic actuator, the hydraulic actuator having an outer cylinder, and a conduit extending from the head member along an outer surface of the outer cylinder and within the inner tube, said conduit being coupled to the outer cylinder to provide hydraulic pressure to an interior of the outer cylinder.

12. The boat lift leg construction of claim 11 and support foot members mounted on the lower end of each of the inner tubes of the telescoping support legs for engaging a supporting surface when the respective second actuator is extended.

13. The boat lift leg construction of claim 6, further comprising an intermediate tube between the inner and outer tubes of each telescoping support leg, bushings between facing surfaces of the telescoping tubes of each telescoping support leg, and cooperating on the respective inner and intermediate tube stops to cause extension of the intermediate tubes from the respective outer tube as the respective inner tubes are extended.

14. The boat lift leg construction of claim 13 wherein the actuator has stops to limit extension, the cooperating stops and the actuator stops limit extension to provide stabilizing overlap of the intermediate tubes with the respective outer and inner tubes of each telescoping support leg.

* * * * *